US007779792B2

(12) United States Patent
Kubo et al.

(10) Patent No.: US 7,779,792 B2
(45) Date of Patent: Aug. 24, 2010

(54) AIR-COOLED ENGINE

(75) Inventors: Yoshihiko Kubo, Wako (JP); Kazuhisa Ogawa, Wako (JP); Hiroshi Koyama, Wako (JP); Akihisa Shinoda, Wako (JP); Kazuhiro Sakamoto, Wako (JP); Souhei Honda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 449 days.

(21) Appl. No.: 11/913,146

(22) PCT Filed: Jun. 16, 2006

(86) PCT No.: PCT/JP2006/312566

§ 371 (c)(1),
(2), (4) Date: Oct. 30, 2007

(87) PCT Pub. No.: WO2006/137508

PCT Pub. Date: Dec. 28, 2006

(65) Prior Publication Data

US 2009/0044769 A1 Feb. 19, 2009

(30) Foreign Application Priority Data

Jun. 23, 2005 (JP) ..... 2005-182830
Jun. 23, 2005 (JP) ..... 2005-182919

(51) Int. Cl.
*F02N 3/02* (2006.01)

(52) U.S. Cl. ..... 123/41.56

(58) Field of Classification Search ..... 123/41.56, 123/41.7, 198 E

See application file for complete search history.

(56) References Cited

U.S. PATENT DOCUMENTS 4,548,167 A * 10/1985 Tamba et al. ..... 123/41.56

(Continued)

FOREIGN PATENT DOCUMENTS

EP 0 894 952 A1 2/1999

(Continued)

OTHER PUBLICATIONS

Japanese Office Action dated Jan. 8, 2010, issued in corresponding Japanese Patent Application No. P2005-182919.

(Continued)

*Primary Examiner*—M. McMahon
(74) *Attorney, Agent, or Firm*—Westerman, Hattori, Daniels & Adrian, LLP

(57) ABSTRACT

An air-cooled engine (10) has a fan cover (16) for covering a cooling fan (14). The cover (16) is composed of a fan-cover peripheral wall (44) for covering the outside of the cooling fan (14), and a top board (45) for closing off one end of the fan-cover peripheral wall (44). The fan-cover peripheral wall (44) has an internally disposed guiding duct (47) for guiding cooling air (Wi) from the cooling fan (14) to an engine main body (12). A first fastening member (42) secures a portion of the external part of the fan-cover peripheral wall (44) that is proximal to the guiding duct (47) to a casing (25) of the engine main body (12). A second fastening member (41) extends from the casing (25) and through the fan-cover peripheral wall (44), and secures a top board (45) in a portion that is at a distance from the guiding duct (47).

10 Claims, 9 Drawing Sheets

U.S. PATENT DOCUMENTS

| | | | | |
|---|---|---|---|---|
| 4,907,546 | A * | 3/1990 | Ishii et al. | 123/41.56 |
| 6,378,467 | B1 * | 4/2002 | Kobayashi et al. | 123/41.56 |
| 6,378,469 | B1 * | 4/2002 | Hiranuma et al. | 123/41.56 |
| 2003/0154934 | A1 | 8/2003 | Nakamizo et al. | |

FOREIGN PATENT DOCUMENTS

| | | | |
|---|---|---|---|
| GB | 2 069 598 | A | 8/1981 |
| JP | 57-153722 | U | 9/1982 |
| JP | 58-19293 | Y2 | 7/1983 |
| JP | 61-183430 | U | 11/1986 |
| JP | 2004-316628 | A | 11/2004 |

OTHER PUBLICATIONS

International Search Report of PCT/JP2006/312566, date of mailing Nov. 15, 2006.

* cited by examiner 10
20
62
63
63a
D2
78
Hi
82c
56c
L1
45
82
(S2)
74
82b
56
52
56g
56h
(S3)
Wi
L2
56a
56b
82a
56e
81a
81d
63a
56f
56d
81
(S1)
81b
D1
81c
Ea
58
49
42
58
64
44
76
77
75

AIR-COOLED ENGINE

TECHNICAL FIELD

The present invention relates to an air-cooled engine, and particularly to an improvement in a fan cover for covering a cooling fan.

BACKGROUND ART

A cooling fan in an air-cooled engine is driven by a crankshaft to send cooling air to a cylinder head and a cylinder block, whereby they are forcibly cooled. This type of air-cooled engine is disclosed in Japanese Examined Utility Model Application No. 58-19293.

The air-cooled engine in Japanese Examined Utility Model Application No. 58-19293 comprises an engine main body, a cooling fan, a recoil starter, and a fan cover for covering the cooling fan and the recoil starter. The recoil starter is manually operated to start up the engine main body.

The fan cover is a roughly cup-shaped member that conducts cooling air sent from the cooling fan to the cylinder head and the cylinder block.

The fan cover is often made from a resinous material in order to achieve a weight reduction and improved productivity. A resinous fan cover is mounted on the crank case of an engine with stud bolts or other such fastening members. For example, the top board of the fan cover is mounted on the distal ends of the stud bolts provided to the crank case at positions on the inner side of the fan cover.

However, a guiding duct for guiding cooling air sent from the cooling fan to the cylinder head and the cylinder block is formed inside the fan cover. When the stud bolts are disposed in this guiding duct, measures must be taken to reduce (1) the wind roar resulting from the cooling air striking the stud bolts, and (2) the transmission resistance resulting from the stud bolts hindering the flow of cooling air. "Wind roar" refers to the loud noise caused by friction between the cooling air and the stud bolts or other such obstacles.

In view of this, there is a need for techniques whereby the occurrence of wind roar can be prevented when cooling air flows through the fan cover, and whereby cooling air can be adequately guided by the fan cover.

DISCLOSURE OF THE INVENTION

The present invention provides an air-cooled engine comprising an engine main body, a cooling fan for generating cooling air while the engine main body is being driven, and a fan cover for covering the cooling fan, wherein the engine main body has a casing; the casing has a lateral portion; the cooling fan and the fan cover are disposed on the lateral portion; the fan cover is an integrated molded article composed of a fan-cover peripheral wall for forming an outside cover for the cooling fan, and a top board for closing off an end of the fan-cover peripheral wall on the side opposite from the casing; the fan-cover peripheral wall has an internally disposed guiding duct for guiding cooling air sent from the cooling fan to a specified location in the engine main body; in a portion of the fan cover that has the guiding duct, a proximal end that is on an outer surface of the fan-cover peripheral wall and is adjacent to the casing is mounted on the casing by a first fastening member; and in a portion of the fan cover that is disposed away from the guiding duct, the top board is mounted on the casing by a second fastening member that extends from the casing to the top board and passes inside the fan-cover peripheral wall.

Therefore, in the portion of the fan cover that has the guiding duct, the proximal end that is disposed externally of the fan-cover peripheral wall and is adjacent to the casing can be mounted with the aid of the first fastening member in cases in which the fan cover is mounted on the casing of the engine main body. Thus, the first fastening member for mounting the fan cover can be disposed outside of the guiding duct. As a result, no components hinder the flow of cooling air to the guiding duct. Therefore, the cooling air generated by the cooling fan can be guided more smoothly by the fan cover to a specified location in the air-cooled engine. As a result, the necessary amount of air for cooling the air-cooled engine can be adequately ensured. Moreover, it is possible to prevent wind roar that occurs due to the cooling air striking obstacles. As a result, loud noises throughout the entire system of the air-cooled engine can be further suppressed.

In the portion of the fan cover that is disposed away from the guiding duct, the top board can be mounted on the casing by a second fastening member. The second fastening member extends from the casing to the top board and passes through the interior of the fan-cover peripheral wall. The fan cover can be mounted on the casing by means of the second fastening member by mounting the top board to the distal end of the second fastening member. Therefore, the top board of the fan cover can be freely mounted at the optimum position. Moreover, the second fastening member can be used as a reinforcing member for the fan cover. Accordingly, adequate rigidity of the fan cover can be ensured.

It is preferable that the air-cooled engine further comprise a recoil starter for starting up the engine main body, and a starter cover for covering the recoil starter, that the recoil starter and the starter cover be disposed on the fan cover externally of the top board, and that the starter cover be secured together with the top board by the second fastening member.

Furthermore, it is preferable that the fan cover comprise a third fastening member for mounting the starter cover to the top board in the vicinity of an axial line of the first fastening member.

Furthermore, it is preferable that the fan cover have integrally formed reinforcing ribs that extend from a portion in which the cover is mounted on the casing by the first fastening member to a portion comprising the third fastening member.

Furthermore, it is preferable that the air-cooled engine comprise a recoil starter for starting up the engine main body, and a starter cover for covering the recoil starter, that the recoil starter and the starter cover be disposed on the fan cover externally of the top board, that the starter cover have a bracket that protrudes so as to extend along the top board, that the bracket have a mounting hole that accommodates a fastening member for mounting the bracket to the top board, and that the surface area of a top part of the cooling air is set to be greater than the surface area of a bottom part of the air, based on the position of the mounting hole in the bracket when the bracket is viewed from the axial direction of the recoil starter.

Furthermore, it is preferable that the top board have reinforcing ribs that are disposed in a top part of the cooling air so as to be in proximity to a mounting position of the bracket, based on the position of the mounting hole.

Furthermore, it is preferable that the top board have a thick-wall part at a position in which the bracket is mounted, and that the bracket be mounted on the thick-wall part by the fastening member.

Furthermore, it is preferable that the thick-wall part have reinforcing ribs.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

Figure 1:
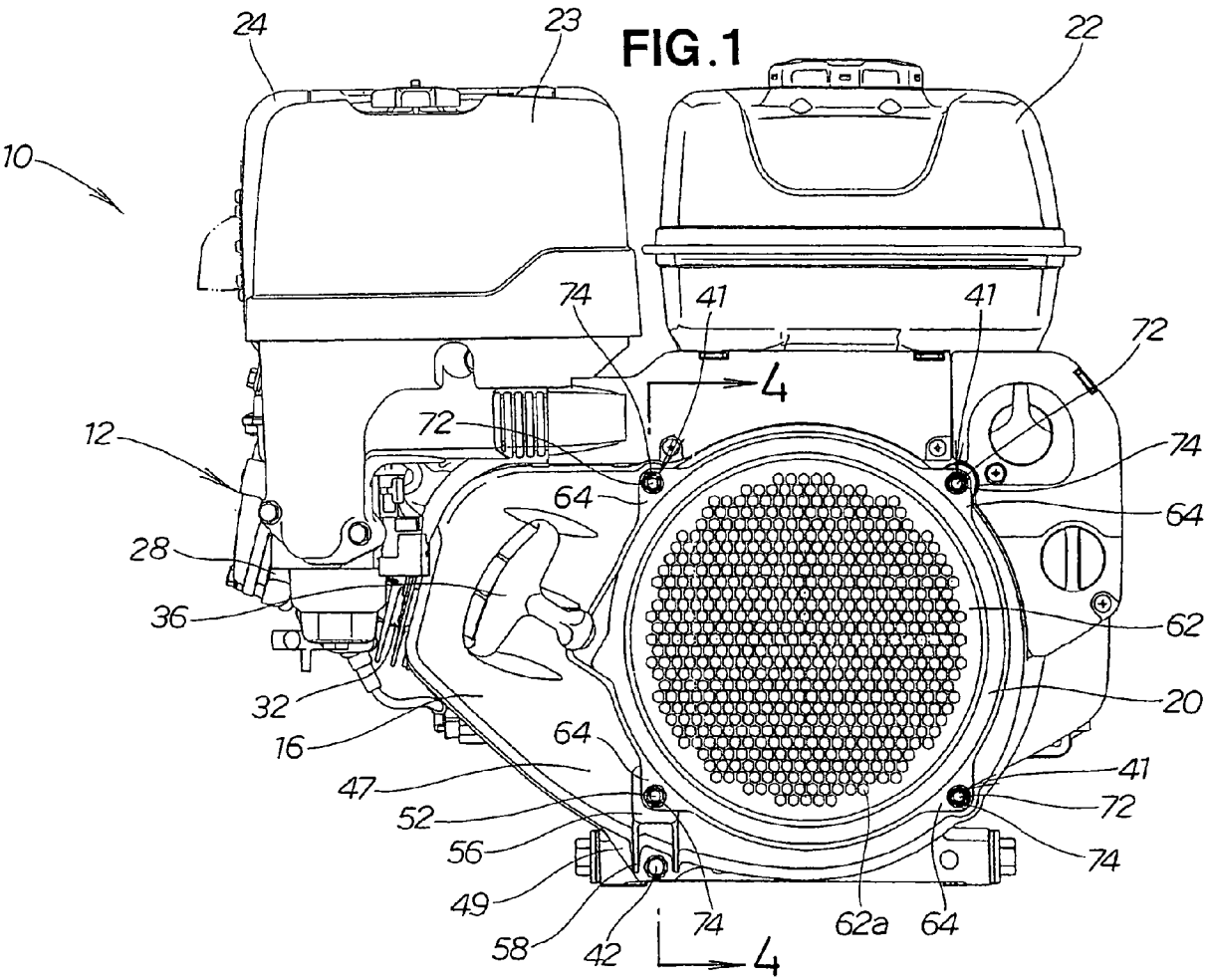
FIG. 1 is an external view of an air-cooled engine according to the present invention.
Figure 2:
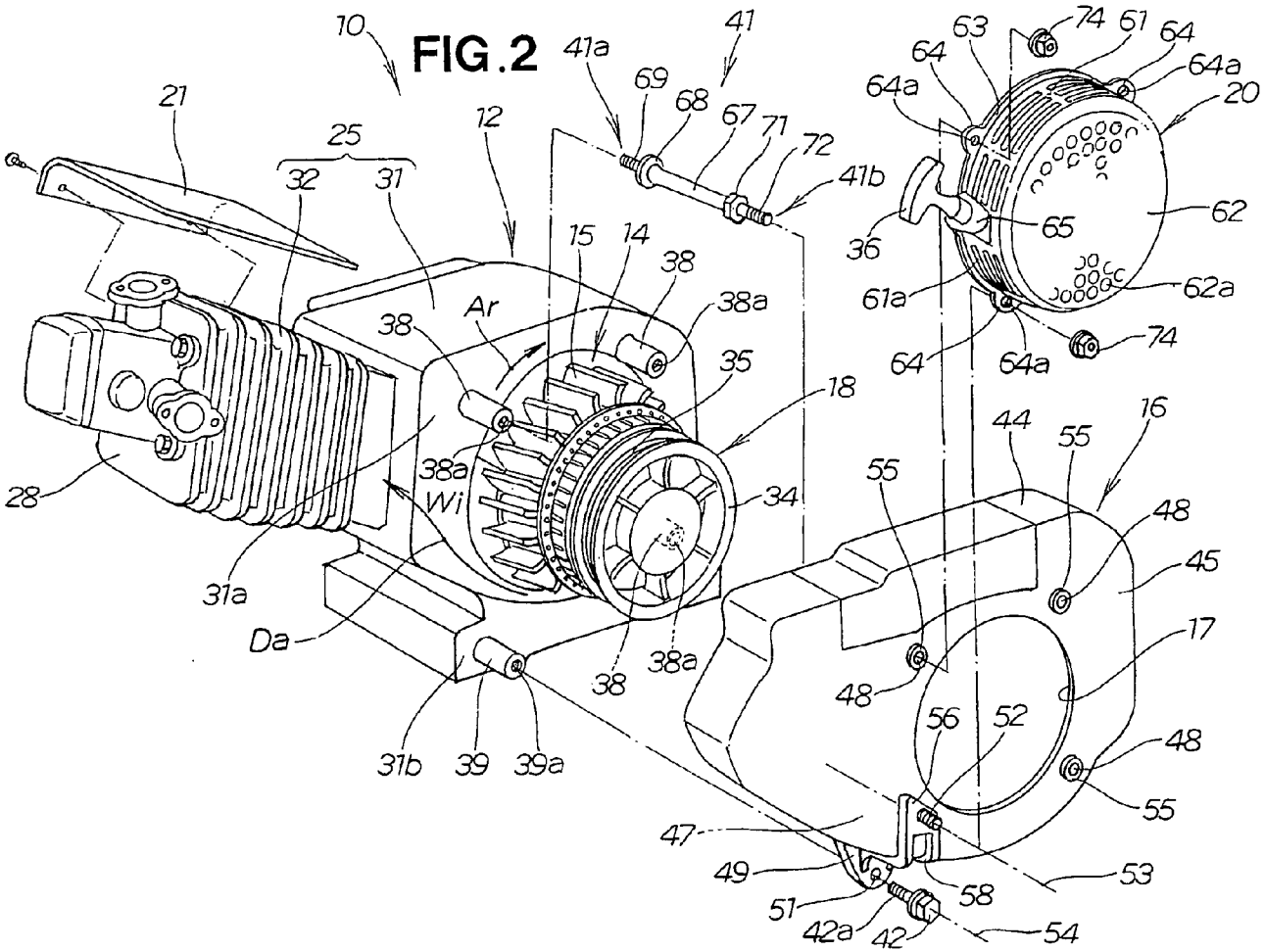
FIG. 2 is an exploded perspective view of the air-cooled engine shown in FIG. 1.

As shown in FIGS. 1 and 2, the air-cooled engine 10 comprises an engine main body 12, a cooling fan 14, a fan cover 16 for covering the cooling fan 14, a recoil starter 18, a starter cover 20 for covering the recoil starter 18, a fuel tank 22, an air cleaner 23, and a muffler 24.

As shown in FIG. 2, the engine main body 12 is a so-called OHC (overhead-cam) single-cylinder engine having a tilted cylinder, wherein a cylinder (not shown) and a cylinder block 32 for housing the cylinder are tilted upward at fixed angles. The engine main body is used as a multipurpose engine.

The casing 25 of the engine main body 12 is composed of a crank case 31, a cylinder block 32 formed integrally in the lateral portion of the crank case 31 (left-hand end in FIG. 2), and a cylinder head 28 disposed at the distal end of the cylinder block 32. The crank case 31 rotatably supports and accommodates a crankshaft 33 (see FIG. 3). The cylinder block 32 houses a cylinder for reciprocatingly accommodating a piston.

The air-cooled engine 10 further comprises a guide cover 21 for covering the tops of both the cylinder head 28 and the cylinder block 32. The guide cover 21 has the function of guiding cooling air Wi sent from the cooling fan 14 along the top of the cylinder block 32. The cover is bolted onto the cylinder head 28 and the cylinder block 32.

Figure 3:
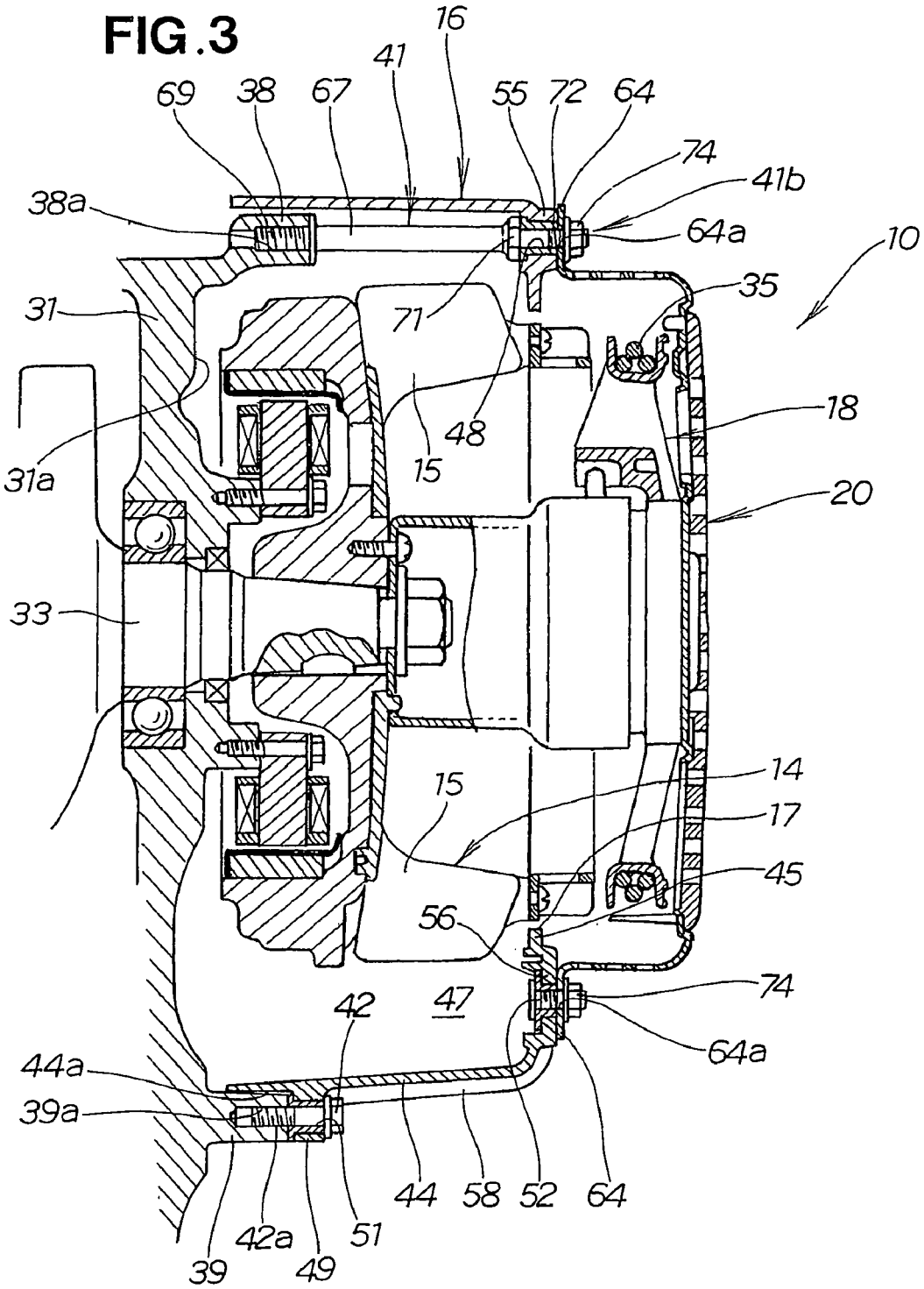
FIG. 3 is a cross-sectional view showing the manner of assembling the cooling fan, the fan cover, the recoil starter, and the starter cover shown in FIG. 2.
Figure 4:
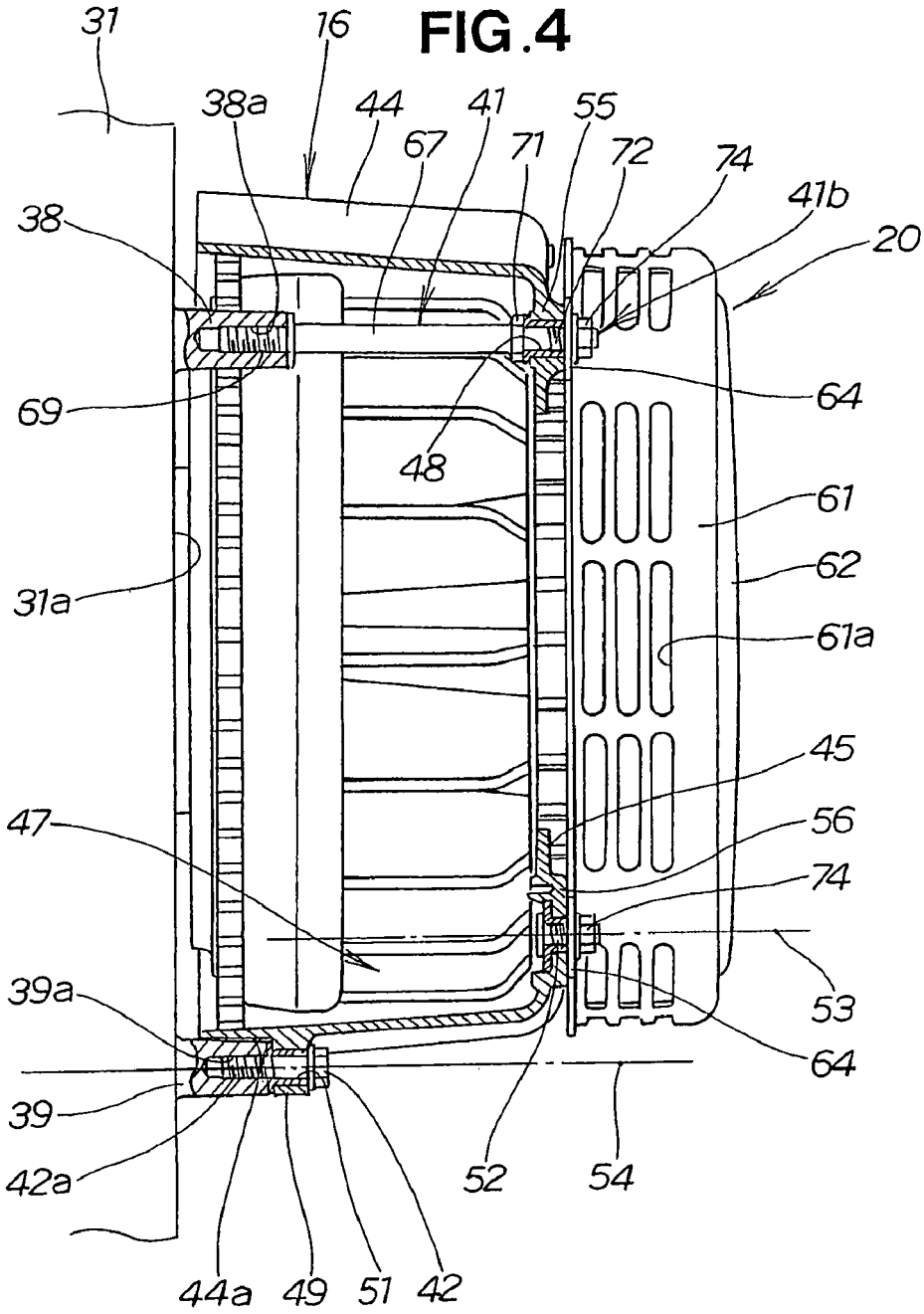
FIG. 4 is a cross-sectional view along the line 4-4 in FIG. 1.

As shown in FIGS. 2 and 3, the cooling fan 14 and the fan cover 16 are disposed in the first lateral portion 31*a* of the crank case 31 (lateral portion 31*a* of the casing 25). The fan cover 16 has an opening 17 for accommodating the recoil starter 18. The recoil starter 18 is disposed externally of the fan cover 16, at a position that faces the opening 17. The cooling fan 14 and the recoil starter 18 are linked to the crankshaft 33.

The cooling fan 14 has a plurality of blades 15 (propellers) arranged in the circumferential direction around the crankshaft 33, and the fan generates cooling air Wi while the engine main body 12 is being driven. Specifically, the cooling fan 14 is driven and rotated by the crankshaft 33, whereby the fan draws in outside air from the rotational center, and sends the drawn-in outside air radially outward. The outside air sent from the cooling fan 14 constitutes the cooling air Wi.

The recoil starter 18 is used to manually drive the air-cooled engine 10 and is provided with a pulley 34 around which a starter rope 35 is wound. The pulley 34 is rotatably supported on the starter cover 20 and is linked to the crankshaft 33 by means of a ratchet. The starter rope 35 has a grip 36 at the distal end. FIG. 2 shows the grip 36 as being detached from the starter rope 35 and positioned on the side of the starter cover 20, for the sake of simplicity. The crankshaft 33 can be turned by manually turning the recoil starter 55.

As shown in FIGS. 2 through 5, the crank case 31 comprises three anchoring bosses 38 on the first lateral portion 31*a*, and one anchoring boss 39 disposed at a position away from the three anchoring bosses 38. The three anchoring bosses 38 are arranged on the periphery of the cooling fan 14 in the circumferential direction around the crankshaft 33, at equal intervals of 90 degrees. The three anchoring bosses 38 have screw holes 38*a* at their distal ends.

As used herein, the term "three anchoring bosses 38" refers, clockwise from the top left in FIG. 2, to a first anchoring boss 38, a second anchoring boss 38, and a third anchoring boss 38. The term "one anchoring boss 39" refers to a fourth anchoring boss 39.

The fourth anchoring boss 39 is disposed on the lateral portion 31*a* of the crank case 31, at the lower end 31*b* of the crank case 31, at a position between the first anchoring boss 38 and the third anchoring boss 38. The fourth anchoring boss 39 has a screw hole 39*a* at the distal end.

The fan cover 16 is a resinous integrally molded article composed of a fan-cover peripheral wall 44 for covering the outside of the cooling fan 14, and a top board 45 (ceiling 45) for closing off the end of the fan-cover peripheral wall 44 on the side opposite from the casing 25.

The fan-cover peripheral wall 44 has an internally disposed guiding duct 47 that guides the cooling air Wi sent from the cooling fan 14 to a specified location in the engine main body 12, i.e., to the cylinder head 28 and the cylinder block 32. Therefore, the cooling air Wi is guided by the guiding duct 47 in the direction of the arrow Da shown in FIG. 2, and flows to the cylinder head 28 and the cylinder block 32.

The top board 45 is a flat plate that closes off the entire fan-cover peripheral wall 44 (including the guiding duct 47) and has a circular opening 17 centered around the crankshaft 33, three mounting holes 48, a single bolt 52, and three thick-wall parts 55. As shown in FIG. 2, the guiding duct 47 is disposed on the fan-cover peripheral wall 44 closer to the cylinder block 32 (to the left side in FIG. 2) and away from the opening 17.

The three mounting holes 48 and the single bolt 52 are arranged on the periphery of the opening 17 in the circumferential direction around the crankshaft 33, at equal intervals of 90 degrees. The positions of the three mounting holes 48 correspond to the positions of the three anchoring bosses 38 that protrude from the lateral portion 31*a* of the crank case 31.

The three mounting holes 48 include a first mounting hole 48 that corresponds to the first anchoring boss 38, a second mounting hole 48 that corresponds to the second anchoring boss 38, and a third mounting hole 48 that corresponds to the third anchoring boss 38.

The bolt 52 is a starter-fastening member that extends from the top board 45 to the starter cover 20 and is used to mount the starter cover 20. The member is disposed at a position between the first anchoring boss 38 and the third anchoring boss 38. In other words, the bolt 52 is disposed in the vicinity of the position occupied by the fourth anchoring boss 39. As a result, the axial line 53 of the bolt 52 lies in the vicinity of the center 54 of the screw hole 39*a*, shown in FIG. 2. The bolt 52 can be appropriately referred to as the third bolt 52 or the third fastening member 52. The third bolt 52 can be configured so as to be inserted via a through-hole in the top board 45, as shown in FIG. 3, or embedded (insertion-molded) in the top board 45.

The three thick-wall parts 55 are portions of the top board 45 that reinforce the periphery of the mounting holes 48. The three thick-wall parts 55 include a first thick-wall part 55 corresponding to the first mounting hole 48, a second thick-wall part 55 corresponding to the second mounting hole 48, and a third thick-wall part 55 corresponding to the third mounting hole 48. Furthermore, the top board 45 has a thick-wall part 56 (fourth thick-wall part 56) that reinforces the periphery around the position of the bolt 52. The third thick-wall part 55 and the fourth thick-wall part 56 increase in thickness from the top board 45 towards the starter cover 20.

As shown in FIGS. 2, 3, 4, and 6, the fan-cover peripheral wall 44 comprises a bracket 49 that is formed integrally on a proximal portion 44*a* adjacent to the lateral portion 31*a* of the crank case 31 on the outer surface. The bracket 49 is a flat-shaped protrusion that protrudes outward from the fan-cover peripheral wall 44 and has a mounting hole 51 running through. This mounting hole 51 is referred to as the fourth mounting hole 51 hereinbelow.

The positions of the bracket 49 and the fourth mounting hole 51 correspond to the position of the fourth anchoring boss 39 (center 54 of the screw hole 39*a* shown in FIG. 2). Specifically, the bracket 49 is disposed in proximity to the guiding duct 47 on the fan-cover peripheral wall 44, and protrudes outward from the proximal portion 44*a*. In other words, the bracket 49 and the fourth mounting hole 51 are disposed externally of the fan-cover peripheral wall 44, on the portion of the fan cover 16 that has the guiding duct 47. The fourth mounting hole 51 can thereby be provided at a position that is in the vicinity of the guiding duct 47 but does not interfere with the guiding duct 47.

Furthermore, the fan cover 16 has a pair of reinforcing ribs 58, 58 that extend from the bracket 49, along the outer surface of the fan-cover peripheral wall 44 and the outer surface of the top board 45, and to the fourth thick-wall part 56. Thus, the fan cover 16 has reinforcing ribs 58, 58 that are integrally formed and extend from the portion in which the fan cover is mounted on the casing 25 by the bolt 42 to the portion that includes the third bolt 52.

The fan cover 16 is detachably mounted on the lateral portion 31*a* of the crank case 31 by a plurality of stud bolts 41 and the bolt 42.

The stud bolts 41 (also referred to as studs) can be appropriately referred to as second bolts 41 or second fastening members 41. The bolt 42 can be appropriately referred to as a first bolt 42 or a first fastening member 42.

The stud bolts 41 are fastening members composed of rods 67 having a specific length, flanges 68 formed in the vicinity of the proximal ends 41*a* of the rods 67, proximal threaded parts 69 formed on the proximal ends 41*a*, heads (hexagonal parts) 71 formed in the vicinity of the distal ends (ends) 41*b* of the rods 67, and distal threaded parts 72 formed on the distal ends 41*b*.

The starter cover 20 is a resinous integrated molded article composed of a cylindrical peripheral wall 61 that is one size larger than the opening 17, a top board 62 for closing off the end of the peripheral wall 61 opposite from the top board 45, and a flange 63 disposed at the end of the peripheral wall 61 on the side facing the top board 45.

The peripheral wall 61 has a plurality of first outside air inlets 61*a*, and a grip support 65. The grip support 65 supports the grip 36 of the recoil starter 18 so as to keep the grip in an upright position to allow grasping by hand. The top board 62 is a flat plate comprising a plurality of second outside air inlets 62*a*. The first and second outside air inlets 61*a*, 62*a* are through-holes for conducting outside air into the starter cover 20.

The flange 63 performs the function of a reinforcing ring that encircles the outer surface of the peripheral wall 61. The rigidity of the starter cover 20 can be increased by the flange 63. Furthermore, the flange 63 comprises four brackets 64. The four brackets 64 are plate-shaped protrusions that protrude outward (extend along the top board 45) in a radial pattern away from the outer peripheral surface of the flange 63. Each of the brackets has a through mounting hole 64*a*.

The four mounting holes 64*a* are arranged in the circumferential direction around the crankshaft 33, at equal intervals of 90 degrees. The positions of the four mounting holes 64*a* correspond to the positions of the three mounting holes 48 and the one bolt 52 in the top board 45.

The four mounting holes 64*a* include a first mounting hole 64*a* corresponding to the first mounting hole 48, a second mounting hole 64*a* corresponding to the second mounting hole 48, a third mounting hole 64*a* corresponding to the third mounting hole 48, and a fourth mounting hole 64*a* corresponding to the third bolt 52.

The four brackets 64 include a first bracket 64 corresponding to the first mounting hole 64*a*, a second bracket 64 corresponding to the second mounting hole 64*a*, a third bracket 64 corresponding to the third mounting hole 64*a*, and a fourth bracket 64 corresponding to the fourth mounting hole 64*a*.

The procedure of mounting the fan cover 16 and the starter cover 20 on the lateral portion 31*a* of the crank case 31 is as follows.

First, the proximal threaded parts 69 of the three stud bolts 41 are screwed into the three screw holes 38*a* of the crank case 31. As a result, the stud bolts 41 stand upward in relation to the lateral portion 31*a*.

Next, as the cooling fan 14 is covered with the fan cover 16, the distal threaded parts 72 of the three stud bolts 41 are inserted into the three mounting holes 48 of the fan cover 16. As a result, the top board 45 is placed on top of the hexagonal parts 71 of the stud bolts 41. The three stud bolts 41 are arranged inside the fan cover 16 in this state.

At substantially the same time, the position of the fourth mounting hole 51 in the fan cover 16 is aligned with the screw hole 39*a* in the crank case 31. Next, the starter cover 20 is placed over the recoil starter 18 and superposed on the top board 45. As a result, the four brackets 64 are superposed on the three thick-wall parts 55 and the thick-wall part 56 on the top board 45. At this time, the distal threaded parts 72 of the three stud bolts 41 are inserted into the three mounting holes 43 (only two are shown) in the starter cover 20. At the same time, the third bolt 52 in the fan cover 16 is inserted into the fourth mounting hole 64*a* in the starter cover 20.

Next, nuts 74 are screwed on the three distal threaded parts 72 and the single bolt 52.

Furthermore, the third bolt 52 is inserted through the fourth mounting hole 51 of the fan cover 16, and the threaded part 42*a* is screwed into the screw hole 39*a*.

The fan cover 16 can thus be mounted on the lateral portion 31*a* of the crank case 31, and the starter cover 20 can be mounted on the fan cover 16.

In this cover mounting structure, the top board 45 and the brackets 64 can be superposed on the hexagonal parts 71 of the stud bolts 41 and fastened on with the aid of the distal threaded parts 72 and the nuts 74. As a result, the top board 45 and the brackets 64 of the starter cover 20 can both be fastened onto the distal ends 41*b* of the stud bolts 41. Therefore, it is possible to reduce the number of fastening means for mounting the starter cover 20 on the fan cover 16. Accordingly, the number of components can be reduced, the assembly process can be simplified, and the number of assembly steps can be reduced.

Next, the manner in which cooling air Wi is caused to flow by the rotation of the cooling fan 14 will be described.

As shown in FIG. 2, the cooling fan 14 is rotated by the crankshaft 33 (see FIG. 3) in the direction of the arrow Ar. The rotating cooling fan 14 generates cooling air Wi, which is forced radially outward by drawing in outside air through outside air inlets 61*a*, 62*a* in the starter cover 20 along the paths of the arrows Ba, Ca (see FIG. 5). The guiding duct 47 guides the cooling air Wi sent from the cooling fan 14 to the cylinder head 28 and the cylinder block 32, as shown by the arrow Da. The cooling air Wi expelled from the guiding duct 47 cools the air-cooled engine 10, and particularly cools the cylinder head 28 and the cylinder block 32. Part of the cooling air Wi moving in the direction of the arrow Da flows upward along the cylinder block 32, and is conducted around the cylinder block 32 by the guide cover 21, further cooling the cylinder block.

Next, the flow of cooling air Wi through the guiding duct 47 with and without the fastening member will be described with reference to FIGS. 7A and 7B.

Figure 7A:
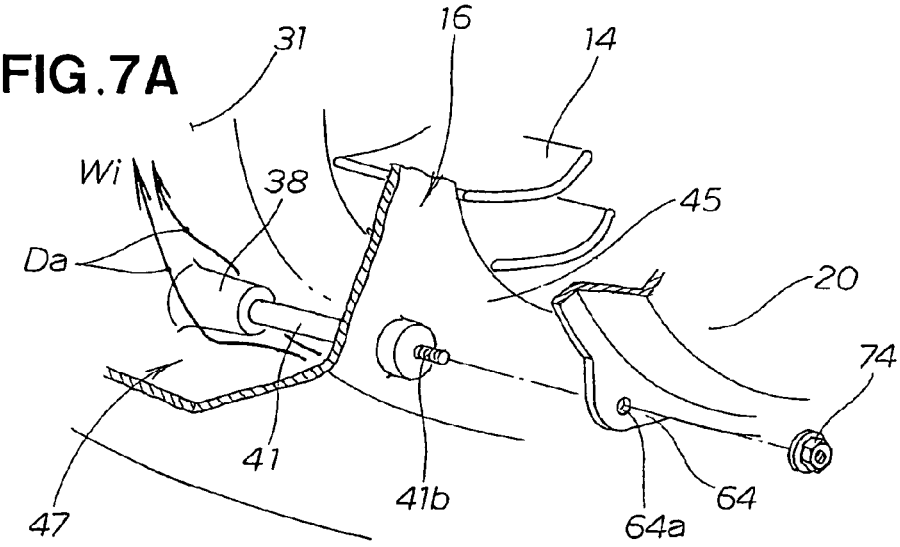
FIGS. 7A and 7B are diagrams illustrating the manner in which cooling air is conducted through the guiding duct shown in FIG. 5.

FIG. 7A is a diagram for describing the flow of cooling air in a comparative example of an air-cooled engine. In the comparative example shown in FIG. 7A, the stud bolts 41 for mounting the fan cover 16 on the crank case 31 shown in FIG. 3 are also disposed at positions in the guiding duct 47. Specifically, in the comparative example, the proximal ends of the stud bolts 41 are screwed into the crank case 31 at positions in the guiding duct 47 of the fan cover 16, and the top board 45 of the fan cover 16 is mounted on the distal ends 41*b* of the stud bolts 41. Therefore, the stud bolts 41 are disposed in the guiding duct 47.

The cooling air Wi sent from the cooling fan 14 is guided by the guiding duct 47 of the fan cover 16 as shown by the arrow Da. When the cooling air Wi flows through the guiding duct 47, the air strikes the stud bolts 41. Therefore, measures must be taken in the comparative example to reduce (1) the wind roar resulting from the cooling air Wi striking the stud bolts 41, and (2) the transmission resistance resulting from the stud bolts 41 hindering the flow of cooling air Wi. "Wind roar" refers to the loud noise caused by friction between the cooling air Wi and the stud bolts 41 or other such obstacles.

Figure 7B:
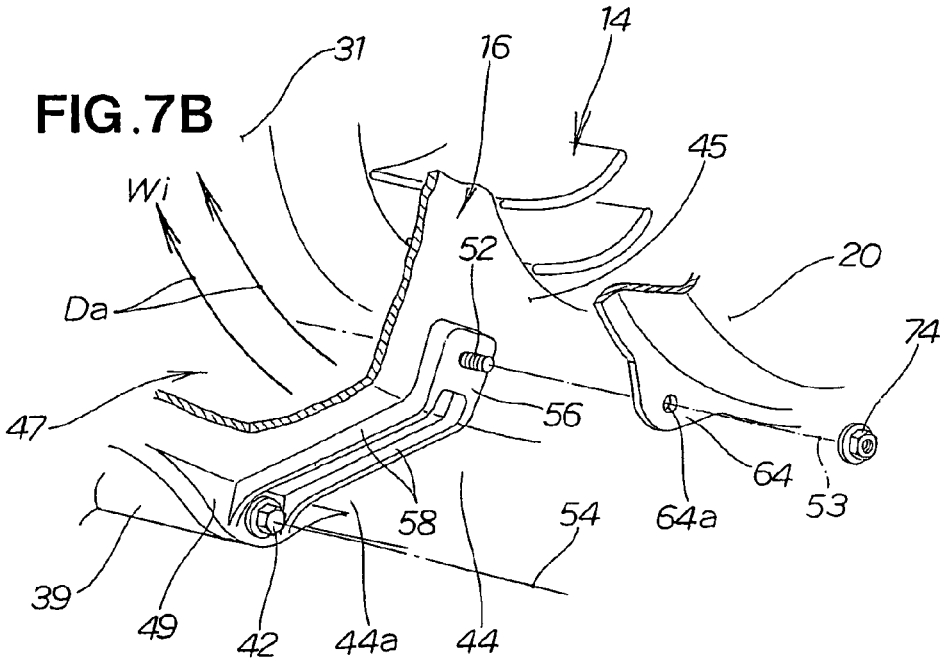

By contrast, the present invention employs the configuration shown in FIGS. 2 and 7B. Essentially, the top board 456 of the fan cover 16 is mounted using all the stud bolts 41 disposed on the interior of the fan-cover peripheral wall 44, as shown in FIG. 2. However, the flow of cooling air Wi is still obstructed because the stud bolts 41 are disposed at positions in the guiding duct 47.

In view of this, the axial line 54 of the first bolt 42 (center 54 of the screw hole 39*a*) in the present invention is disposed externally of the guiding duct 47 in relation to the axial line 53 of the third bolt 52, and such an arrangement is adopted solely in the portion of the fan cover 16 in which the guiding duct 47 is located.

FIG. 7B is a diagram for describing the flow of cooling air Wi in the air-cooled engine 10 of the present invention. In the present invention as shown in FIGS. 2 and 7B, the portion of the fan cover 16 in which the guiding duct 47 is located is designed so that the proximal portion 44*a* that is on the outer surface of the fan-cover peripheral wall 44 and is adjacent to the crank case 31 (casing 25) is mounted on the crank case 31 by the first bolt 42.

Therefore, when the fan cover 16 is mounted on the crank case 31, the proximal portion that is on the outer surface of the fan-cover peripheral wall 44 and is adjacent to the crank case 31 can be mounted with the aid of the first bolt 42 in the portion of the fan cover 16 in which the guiding duct 47 is disposed. Thus, the first bolt 42 for mounting the fan cover 16 can be disposed externally of the guiding duct 47. In other words, the first bolt 42 is disposed at a position in which the guiding duct 47 is unobstructed.

As a result, there are no components (for example, stud bolts 41) in the guiding duct 47 that obstruct the flow of cooling air Wi. Therefore, the cooling air Wi produced by the cooling fan 14 can be guided more smoothly by the fan cover 16 to a specific location in the air-cooled engine 10. As a result, a sufficient amount of air needed to cool the air-cooled engine 10 can be ensured. Moreover, wind roar resulting from the cooling air Wi striking obstructions can be prevented. As a result, loud noises throughout the system of the air-cooled engine 10 can be further suppressed.

Figure 5:
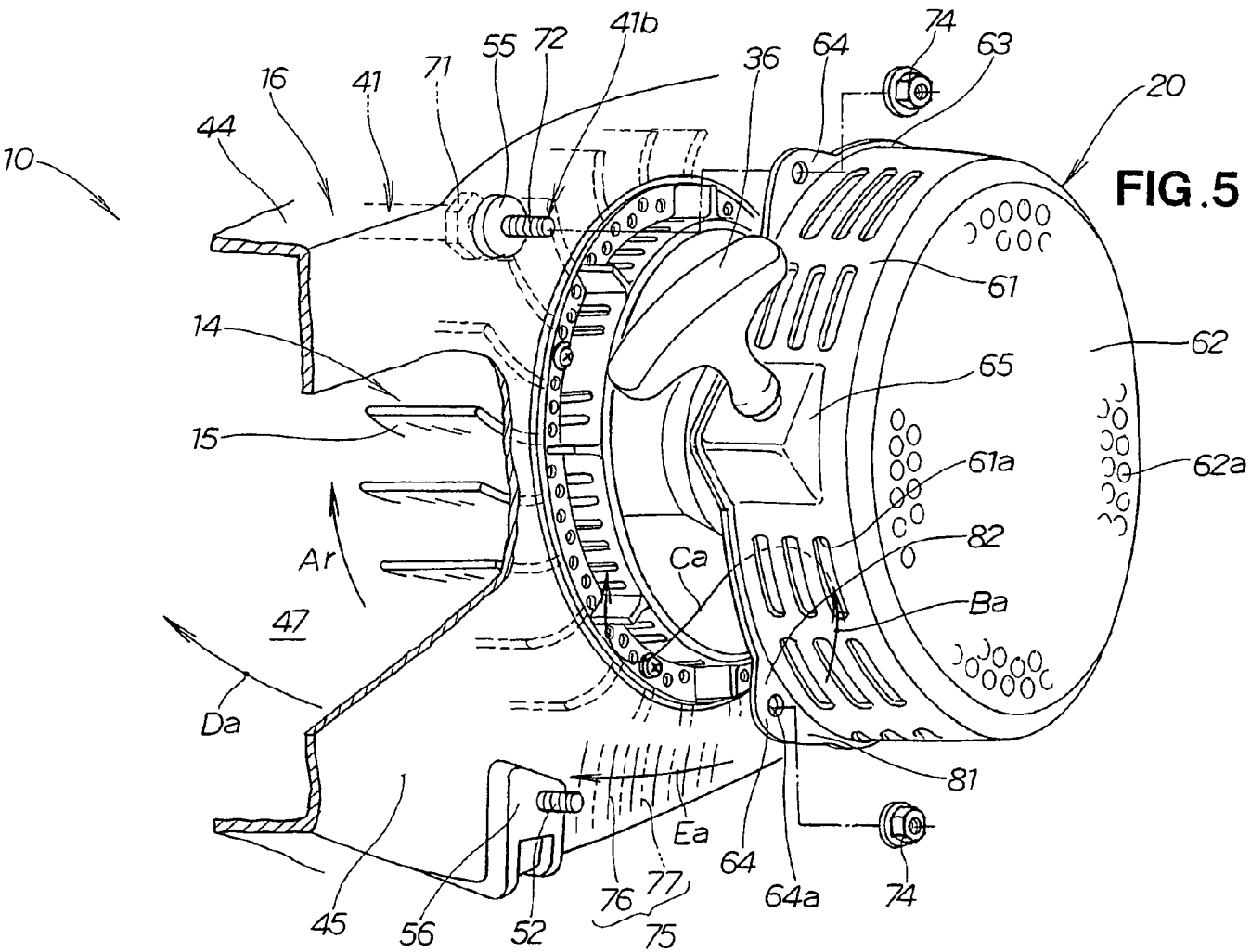
FIG. 5 is an exploded perspective view of the area surrounding the fan cover and the starter cover shown in FIG. 3.
Figure 6:
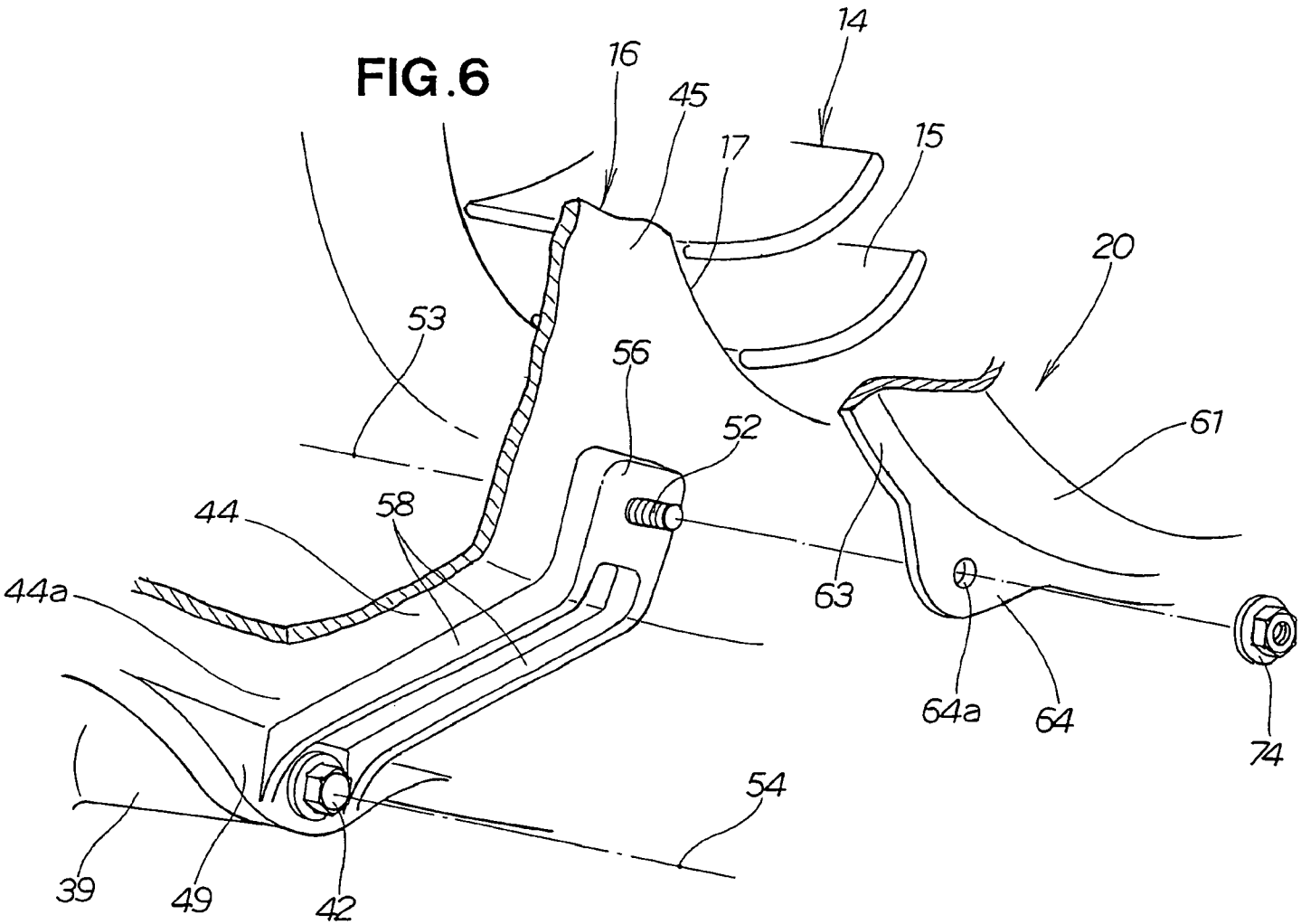
FIG. 6 is an exploded perspective view of the area surrounding the first fastening member and the third fastening member shown in FIG. 3.

As shown in FIG. 5, the top board 45 can be mounted on the crank case 31 with the aid of the stud bolts 41 in the portion of the fan cover 16 that is at a distance from the guiding duct 47. The stud bolts 41 are members that pass from the crank case 31, through the interior of the fan-cover peripheral wall 44, and to the top board 45. The fan cover 16 can be mounted on the crank case 31 via the stud bolts 41. This can be achieved by mounting the top board 45 on the distal ends 41*b* of the stud bolts 41. Therefore, the top board 45 of the fan cover 16 can freely be mounted at the optimum position. Moreover, the stud bolts 41 can be used as reinforcing members for the fan cover 16. Accordingly, sufficient rigidity can be ensured in the fan cover 16.

Furthermore, as shown in FIG. 7B, the fan cover 16 has the third bolt 52 for mounting the starter cover 20 on the top board 45 in the vicinity of the axial line 54 of the first bolt 42. Therefore, the region in the vicinity of the third bolt 52 can be adequately held in place by the bolt 42. Accordingly, when air pressure from the cooling air Wi is applied inside the fan cover 16, the displacement of the third bolt 52 can be adequately reduced.

Furthermore, as shown in FIG. 7B, the fan cover 16 has a pair of integrally formed reinforcing ribs 58, 58. These ribs extend from the portion in which the fan cover 16 is mounted on the crank case 31 by the first bolt 42 to the portion in which the third bolt 52 is provided. Thus, the area of the fan cover 16 that has the brackets 49 and the fourth thick-wall part 56 is reinforced by the pair of reinforcing ribs 58, 58.

Therefore, the displacement of the fourth thick-wall part 56 and of the top board 45 (including deformation) can be reduced even when a large load is applied to the fourth thick-wall part 56 (top board 45) from the starter cover 20 through the third bolt 52. Specifically, it is possible to adequately ensure that the fan cover 16 will have the same rigidity as the portion in which the top board 45 is mounted using the stud bolts 41, as shown in FIG. 3.

In the above description, only bolt structures were described as fastening members 41, 42, 52. In practice, the first fastening member 42 is a combination of the first bolt 42 and the screw hole 39. The second fastening member 41 is a combination of the second bolt 41 and a nut 74. The third fastening member 52 is a combination of the third bolt 52 and a nut 74. The fastening members 41, 42, 52 are not limited to bolts and nuts, and may also be rivets, for example.

Next, a configuration will be described aimed at reducing the vibration generated in the top board 45 of the fan cover 16 when the cooling fan 14 is rotated.

As shown in FIG. 5, air pressure is generated inside the fan cover 16 by the cooling air Wi produced by the cooling fan 14. The blades 15 in the cooling fan 14 are arranged at a fixed pitch. Therefore, the flow of cooling air sent by the blades 15 has a pulsation. As a result, a so-called pulsation is produced in the air pressure applied inside the fan cover 16. It is believed that vibration 75 is generated in the top board 45 along with the pulsation, and this vibration acts in the direction of the arrow Ea from the top side of the path of the cooling air Wi to the bottom side. FIG. 5 schematically depicts the state of the vibration 75 in the top board 45 in solid lines 76 and dashed lines 77. The solid lines 76 show the manner in which the top board 45 protrudes outward, and the dashed lines 77 show the manner in which the top board 45 caves inward.

The fan cover 16 and the starter cover 20 are resinous articles. The top board 45 of the fan cover 16 is composed of a flat plate. A resinous flat plate has a low vibration resonance point but generally deforms more easily than a steel flat plate when subjected to air pressure or other external forces. In other words, a resinous flat plate more easily bears the effects of vibration.

In view of this, the top board 45 of the fan cover 16 and the fourth bracket 64 of the starter cover 20 in the present invention are improved in the following manner in order to reduce the vibration 75 generated in the top board 45.

Figure 8:
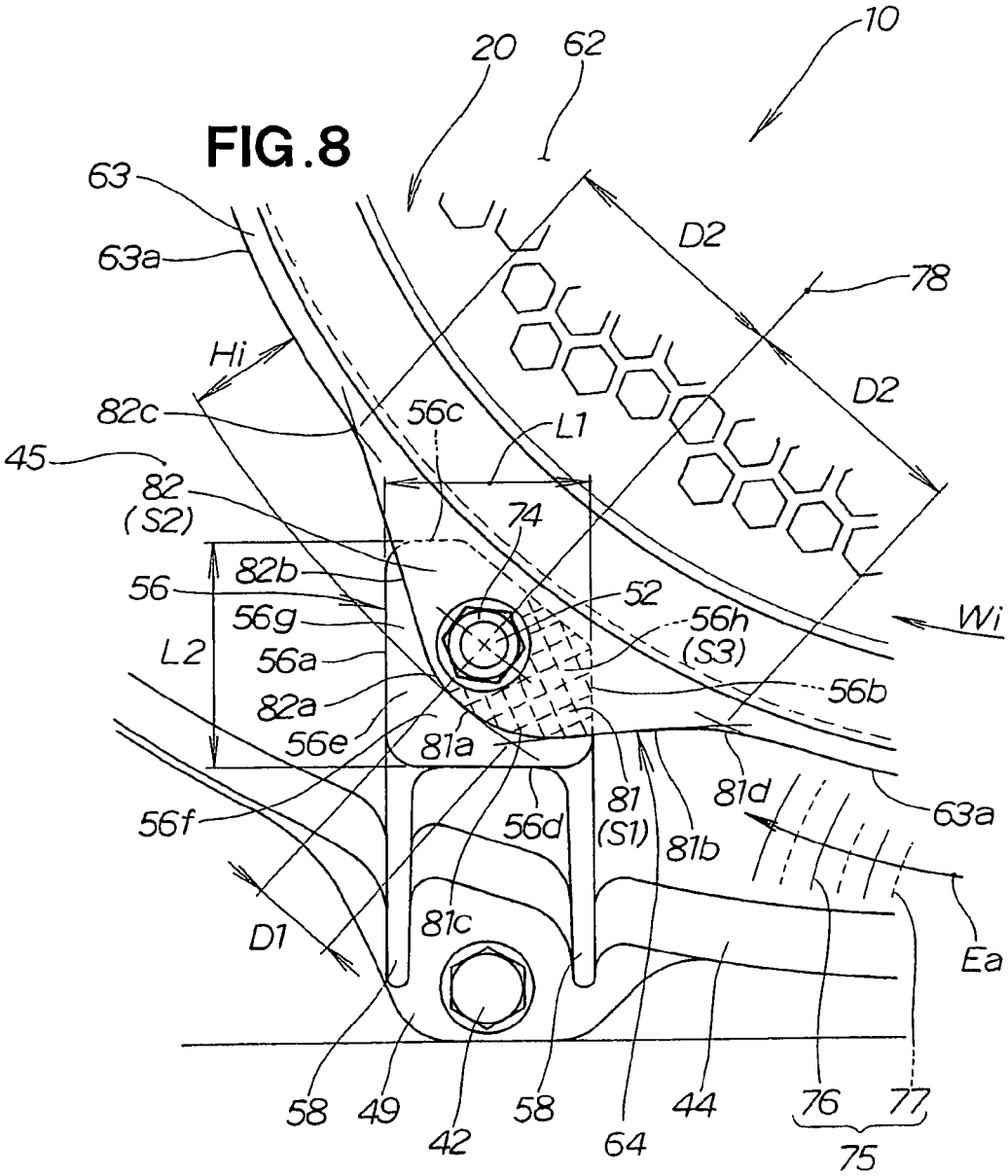
FIG. 8 is an enlarged view of the area surrounding the mounted part of the starter cover shown in FIG. 4.

As shown in FIG. 8, the fourth thick-wall part 56 of the top board 45 is formed into a substantial pentagonal shape when viewed from the starter cover 20. Specifically, the fourth thick-wall part 56 increases in thickness at a certain height from the top board 45 towards the starter cover 20. In FIG. 8, the fourth thick-wall part 56 has front and back walls 56*a*, 56*b* formed parallel to each other at a distance L1, top and bottom walls 56*c*, 56*d* formed parallel to each other at a distance L2, and a flat front surface 56*e*.

A straight line 78 passing through the center of the fourth mounting hole 64*a* (see FIG. 3) and the center of the crankshaft 33 (see FIG. 3) is referred to herein as the center line 78 of the fourth mounting hole 64*a*. The front surface 56*e* is divided into a top airflow region 56*f* and a bottom airflow region 56*g*, based on the center line 78 of the fourth mounting hole 64*a*. The pair of reinforcing ribs 58, 58 extends to the brackets 49 from the side of the bottom wall 56*d* that faces the front and back walls 56*a*, 56*b*, and are parallel to each other at a fixed distance.

As shown in FIG. 8, the entire fourth bracket 64 in the starter cover 20 has a substantial chevron shape, and the peak of the chevron shape is formed into an arc when viewed from the side of the top board. Hi is the height from the peripheral edge 63*a* of the flange 63 to the distal end of the fourth bracket 64, i.e., to the peak of the chevron shape (peak edges 81*a*, 82*a*). The position of the chevron peak is set in a range in which the peak does not extend from the front surface 56*e* of the fourth thick-wall part 56.

The fourth bracket 64 is composed of a top airflow region 81 and a bottom airflow region 82, based on the center line 78 of the fourth mounting hole 64*a*. The top airflow region 81 is the top half of the airflow above the center line 78. The bottom airflow region 82 is the bottom half of the airflow below the center line 78. When the fourth bracket 64 is viewed from the side of the top board 62, the surface area S1 of the top airflow region 81 is greater than the surface area S2 of the bottom airflow region 82. The height of the peak edge 81*a* of the top airflow region 81 and the height of the peak edge 82*a* of the bottom airflow region 82 are both equal to the height Hi of the fourth bracket 64.

More specifically, the contours of the top airflow region 81 are composed of a peak edge 81*a* formed into an arcuate shape along the peripheral edge 63*a*, an inclined edge 81*b* formed at an incline from the peak edge 81*a* to the peripheral edge 63*a*, a peak-side linking edge 81*c* formed in an arcuate shape between the peak edge 81*a* and the inclined edge 81*b*, and a proximal linking edge 81*d* formed in an arcuate-shape between the inclined edge 81*b* and the peripheral edge 63*a*. The distance from the center line 78 to the peak-side linking edge 81*c* is D1. The distance from the center line 78 to the proximal linking edge 81*d* is D2.

The contours of the bottom airflow region 82 are composed of a peak edge 82*a* formed in an arcuate shape along the peripheral edge 63*a*, an inclined edge 82*b* formed at an incline from the peak edge 82*a* to the peripheral edge 63*a*, a peak-side linking edge 82*c* formed in an arcuate shape between the peak edge 82*a* and the inclined edge 82*b*, and a proximal linking edge 82*d* formed in an arcuate shape between the inclined edge 82*b* and the peripheral edge 63*a*. The proximal linking edge 82*d* is positioned in the vicinity of the center line 78. In other words, the distance from the center line 78 to the peak-side linking edge 82*c* is much less than D1. The distance from the center line 78 to the proximal linking edge 82*d* is identical to that in the top airflow region 81, which is D2. Accordingly, as described above, the surface area S2 of the bottom airflow region 82 is less than the surface area S1 of the top airflow region 81.

The fourth bracket 64 can be pressed against the front surface 56*e* of the fourth thick-wall part 56 by inserting the third bolt 52 through the fourth mounting hole 64*a* in the fourth bracket 64 and fastening a nut 74 onto the third bolt 52.

Another possibility is to superpose the fourth bracket 64 over the front surface 56*e* of the fourth thick-wall part 56. As described above, the front surface 56*e* is divided into a top airflow region 56*f* and a bottom airflow region 56*g*, using the center line 78 as a reference.

The range of the area 56*h* in the top airflow region 56*f* over which the top airflow region 81 is superposed is indicated by the cross-hatching in FIG. 8, and the surface area of this range is S3. In other words, the cross-hatched area 56*h* is under pressure from the top airflow region 81. Since the top airflow region 81 is designed to have a large surface area S1, the surface area S3 of the top airflow region 56*h* under pressure from the top airflow region 81 can be increased. Therefore, the top airflow regions of the bolts 52 can be subjected to pressure within a wide range by the top airflow region 81.

As shown in FIG. 1, the first through third brackets 64 do not need to be formed in the same shape as the fourth bracket 64. However, the first through third brackets 64 are formed into the same shape as the fourth bracket 64 in view of consideration related to the outward appearance of the air-cooled engine 10.

Figure 9A:
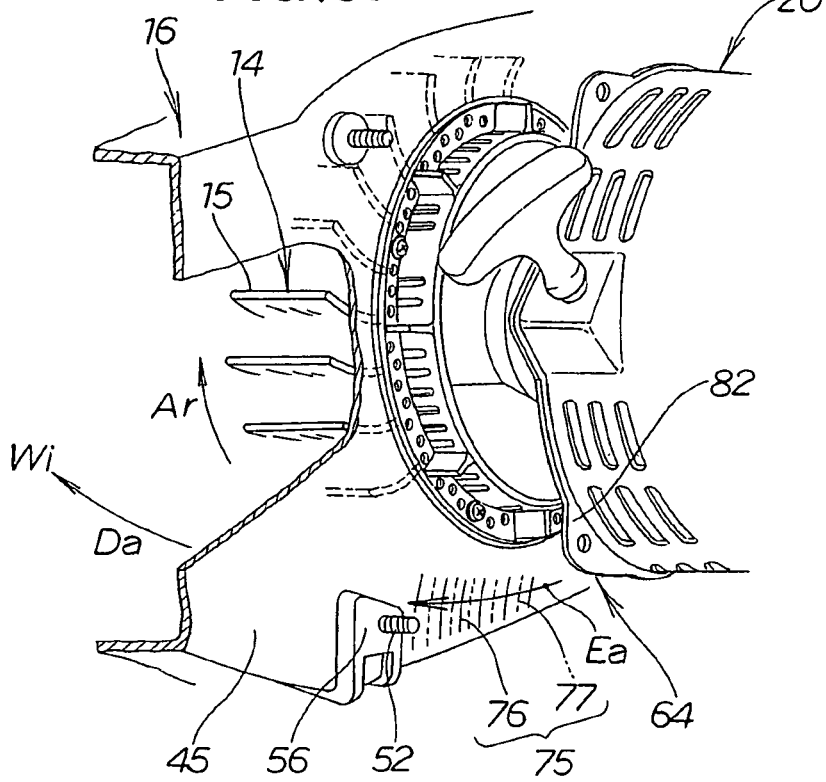
FIGS. 9A and 9B are diagrams illustrating the operation of the area surrounding the mounted part of the starter cover shown in FIGS. 5 and 8.
Figure 9B:
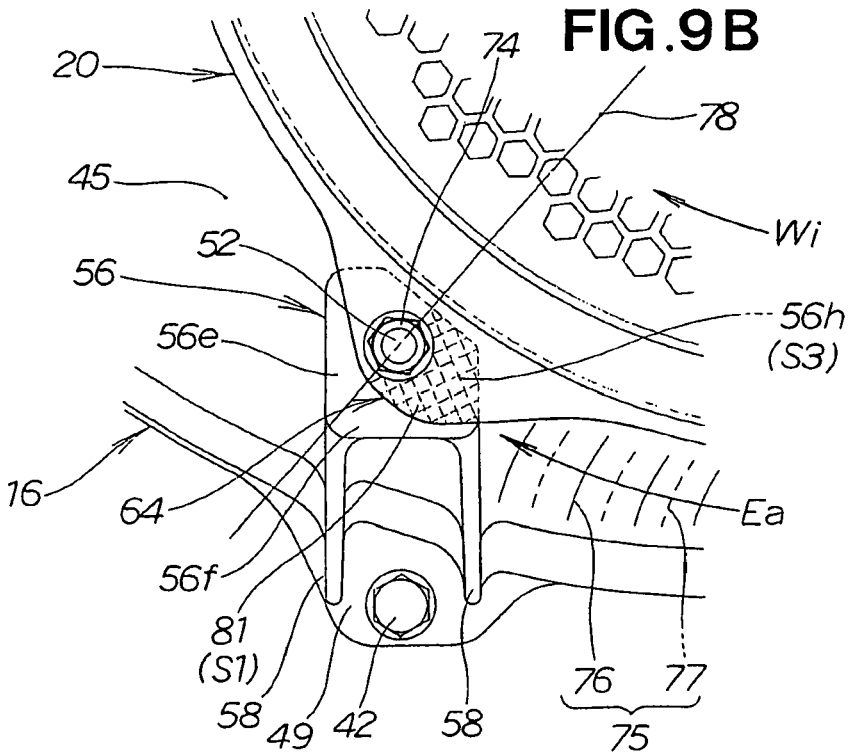

Next, the effects of the vibration 75 generated in the top board 45 of the fan cover 16 will be described with reference to FIGS. 5, 8, 9A, and 9B. FIG. 9A is a diagram corresponding to FIG. 5. FIG. 9B is a diagram corresponding to FIG. 8.

As shown in FIG. 9A, air pressure is created inside the fan cover 16 by the cooling air Wi produced by the cooling fan 14. This air pressure creates vibration 75 in the top board 45 in the direction of the arrow Ea, from the top of the cooling air Wi to the bottom. This vibration 75 repeats in cycles from the front to the back (in the thickness direction) of the top board 45.

As shown in FIG. 2, the fan cover 16 is mounted on the crank case 31 at four locations. Of these four locations, only the location in which the first bolt 42 is mounted is slanted from the locations in which the other three stud bolts 41 are mounted. The starter cover 20 is mounted on the top board 45 of the fan cover 16 at four locations, which are arranged at equal intervals in the circumferential direction of the same circle centered around the crankshaft 33 (see FIG. 3). Therefore, the location in which the third bolt 52 is mounted is misaligned relative to the location in which the first bolt 42 is mounted.

As a result, a greater repeating load acts on the portion of the top board 45 and the fourth bracket 64 that is fastened with the third bolt 52 than on the other portions. Therefore, it is preferable that the fourth bracket 64 have greater durability against vibration and that the backlash of the third bolt 52 and the nut 74 can be reduced.

Accordingly, as shown in FIG. 9B, the fourth thick-wall part 56 and the fourth bracket 64 are fastened together by the third bolt 52 and the nut 74. In this case, the fourth thick-wall part 56 and the fourth bracket 64 are superposed in the cross-hatched range.

In the present invention, the surface area S1 of the top airflow region 81 can be set to be greater than the surface area S2 of the bottom airflow region 82 by increasing the distance D1 from the position of the third bolt 52 (position of the fourth bracket 64) to the peak-side linking edge 81*c*, as shown in FIG. 8. As a result, the surface area S3 of the cross-hatched range increases proportionately. Therefore, the area 56*f* of the fourth thick-wall part 56 above the third bolt 52 can be subjected to pressure by the top airflow region 81 over a wide range.

Thus, the durability of the top airflow region 81 of the fourth bracket 64 can be further improved. Furthermore, when the vibration 75 is generated in the direction of the arrow Ea from the top of the cooling air Wi to the bottom, the resulting vibration 75 can be reduced in the top airflow region 81 and prevented from spreading to the bolts 52 and nuts 74. Thus, the vibration 75 generated in the top board 45 can be prevented from spreading to the bolts 52, and the nuts 74 can be prevented from loosening due to vibration. This can be achieved with a simple configuration in which the top airflow region 81 is merely given a larger surface area S1.

Moreover, the starter cover 20 can be reduced in size and weight because the surface area S2 of the bottom airflow region 82 is not increased.

Furthermore, the top board 45 has a fourth thick-wall part 56 at a location in which the fourth bracket 64 is mounted, and the fourth bracket 64 is mounted on the fourth thick-wall part 56 by using the third bolt 52, as shown in FIG. 9B. Moreover, the fan cover 16 is reinforced (linked) using the reinforcing ribs 58, 58 between the third, fourth thick-wall parts 56 and the brackets 49 mounted on the crank case 31 by the bolts 42. The reinforcing ribs 58, 58 are provided at the top part of the cooling air Wi above the location of the fourth mounting hole 64*a*.

Therefore, displacement (including deformation) in the fourth thick-wall part 56 or the top board 45 can be reduced even in cases in which a large load is applied by the third bolt 52 between the starter cover 20 and the fourth thick-wall part 56 (top board 45). Specifically, the fan cover 16 can be adequately ensured to have the same rigidity as the portion in which the top board 45 is mounted using the stud bolts 41, as shown in FIG. 3. Moreover, the vibration 75 generated in the top board 45 can be prevented from spreading to the bolts 52.

Furthermore, the fourth bracket 64 can be formed with substantially linear symmetry in relation to the center line 78, and a satisfactory outward appearance can be maintained.

In the present invention, the number of bolts 41, 42, 52 used is arbitrary.

Also, arbitrary shapes and sizes have been used for the thick-wall parts 55, 56, the reinforcing ribs 58, and the brackets 49, 64.

INDUSTRIAL APPLICABILITY

The present invention can be appropriately applied to an air-cooled engine in which cooling air blown from a cooling fan is guided to a cylinder block by a fan cover.

The invention claimed is:

1. An air-cooled engine comprising:

an engine main body including a casing;

a cooling fan generating cooling air while the engine main body is driven; and a fan cover covering the cooling fan; wherein the cooling fan and the fan cover are disposed on a lateral portion of the casing, the fan cover is an integrated molded article composed of a fan-cover peripheral wall for forming an outside cover for the cooling fan, and a top board for closing off an end of the fan-cover peripheral wall on the side opposite from the casing, the fan-cover peripheral wall has an internally disposed guide duct guiding cooling air sent from the cooling fan to a specified location in the engine main body, in a first portion of the fan cover that has the guide duct, a proximal portion that is external to an outside surface of the fan-cover peripheral wall and is adjacent to the casing is mounted on the casing by a first fastening member; and in a second portion of the fan cover that is disposed away from the guide duct, the top board is mounted on the casing by a second fastening member that extends from the casing to the top board and passes inside the fan-cover peripheral wall.

2. The air-cooled engine of claim 1, further comprising:

a recoil starter for starting up the engine main body, and a starter cover for covering the recoil starter; and characterized in that the recoil starter and the starter cover are disposed on the fan cover externally of the top board; and the starter cover is secured together with the top board by the second fastening member.

3. The air-cooled engine of claim 2, wherein the fan cover comprises a third fastening member for mounting the starter cover to the top board in the vicinity of an axial line of the first fastening member.

4. The air-cooled engine of claim 3, wherein the fan cover has integrally formed reinforcing ribs that extend from a portion in which the cover is mounted on the casing by the first fastening member to a portion comprising the third fastening member.

5. The air-cooled engine of claim 1, further comprising:

a recoil starter for starting up the engine main body, and a starter cover for covering the recoil starter; said air-cooled engine characterized in that the recoil starter and the starter cover are disposed on the fan cover externally of the top board;

the starter cover has a bracket that protrudes so as to extend along the top board;

the bracket has a mounting hole that accommodates a fastening member for mounting the bracket to the top board; and the surface area of a top part of the cooling air is set to be greater than the surface area of a bottom part of the air, based on the position of the mounting hole in the bracket when the bracket is viewed from the axial direction of the recoil starter.

6. The air-cooled engine of claim 5, wherein the top board has reinforcing ribs that are disposed in the top part of the cooling air so as to be in proximity to a mounting position of the bracket, based on the position of the mounting hole.

7. The air-cooled engine of claim 5, wherein the top board has a thick-wall part at a position in which the bracket is mounted; and the bracket is mounted on the thick-wall part by the fastening member.

8. The air-cooled engine of claim 7, wherein the top board has reinforcing ribs that are disposed in the top part of the cooling air so as to be in proximity to a mounting position of the bracket, based on the position of the mounting hole.

9. The air-cooled engine of claim 7, wherein:

the thick-wall part has reinforcing ribs.

10. The air-cooled engine of claim 9, wherein:

the reinforcing ribs are provided in a top part of the cooling air, based on the position of the mounting hole.

* * * * *